US006365882B1

(12) United States Patent
Stabile

(10) Patent No.: US 6,365,882 B1
(45) Date of Patent: Apr. 2, 2002

(54) THIN HEATING ELEMENT MADE FROM LOW RESISTANCE MATERIAL

(75) Inventor: Aldo Stabile, Crema (IT)

(73) Assignee: Cadif SRL, Verona (IT)

( * ) Notice: Subject to any disclaimer, the term of this patent is extended or adjusted under 35 U.S.C. 154(b) by 0 days.

(21) Appl. No.: 09/582,592

(22) PCT Filed: Apr. 20, 1998

(86) PCT No.: PCT/IT98/00092

§ 371 Date: Jun. 28, 2000

§ 102(e) Date: Jun. 28, 2000

(87) PCT Pub. No.: WO99/38358

PCT Pub. Date: Jul. 29, 1999

(30) Foreign Application Priority Data

Jan. 27, 1998 (IT) ..... MI98A0139

(51) Int. Cl.[7] ..... H05B 3/06

(52) U.S. Cl. ..... 219/542; 219/213; 219/520; 219/536; 219/537; 219/443.1

(58) Field of Search ..... 219/200, 213, 219/218, 520, 525, 532, 534, 536, 537, 538, 539, 542, 548, 552, 443.1, 451.1, 452.11, 454.12

(56) References Cited

U.S. PATENT DOCUMENTS

| | | | |
|---|---|---|---|
| 3,833,793 | A | 9/1974 | Williams |
| 4,542,268 | A | 9/1985 | Jarvis |
| 4,602,238 | A | 7/1986 | Furteck |

FOREIGN PATENT DOCUMENTS

| | | | |
|---|---|---|---|
| WO | 95 22236 | A | 8/1995 |

OTHER PUBLICATIONS

Patent Abstract of Japan vol. 015, No. 121 (E–1049), Mar. 25, 1998 & JP 03 011584 A, Jan. 18, 1991.

Imhof, A.: "Folienelemente Zur Flaechenerwaermung Der . . . ", Schweizerische Technische Zeitschrift, vol. 70, No. 9, Mar. 1, 1973, pp. 153–159.

*Primary Examiner*—Tu Ba Hoang
(74) *Attorney, Agent, or Firm*—Michael J. Striker

(57) ABSTRACT

A system for transforming electrical energy into thermal energy, already diffused has a flat support, and a substantially continuous heat-emitting surface formed by one or more electrically conducting continuous strips, each having a constant thickness, laid flat in parallel lengths and spaced for electrical insulation, the strips being arranged on the flat support and mechanically connected to it.

20 Claims, 3 Drawing Sheets

THIN HEATING ELEMENT MADE FROM LOW RESISTANCE MATERIAL

BACKGROUND OF THE INVENTION

Innumerable process and means exist for generating heat essentially based on combustion especially of gas, and on electrical resistance.

Heat is transferred by conduction, convection and radiation, energy being transferred respectively among contiguous molecules, molecules, electromagnetic waves.

In the case of conduction and convection, generally speaking a thermal chain is created that conditions the performance of an installation to a considerable extent.

Combustible gas for example feeds a burner whose flame, transforming energy from the gas into thermal energy, heats the water of a boiler that heats central heating panels which in turn warm the air close to them. As it warms up the air becomes lighter and, in doing so, rises drawing in cold air towards the panels where it in turn becomes heated.

A convective movement of air is thus created which warms the surrounding space.

In the case of radiation the electromagnetic waves, of suitable length, substantially heat objects while the air remains transparent.

This phenomenon, in an accentuated form in microwave ovens, creates considerable advantages not only environmental but also for materials and products generally, dispersal of heat in the air being almost entirely avoided since it is concentrated in the bodies to be heated.

A heating installation that operates by radiation works somewhat like a microwave oven, except that it functions by radiating energy at a lower frequency and on a longer wavelength.

These advantages however are lessened by the fact that present systems are based on use of highly resistant materials becoming heated to very high temperatures with a high concentration of heat when electric current is passed through them.

These temperatures are nearly always much higher than those needed for indoor heating, for ovens and for various appliances.

Receiving heat at very high temperatures these appliances need specially made and costly means of diffusion.

The high temperatures of resistance require supporting means of special materials such as ceramics and the like, that are difficult to construct, as well as fragile and complex structures for insulation and covering that rapidly become obsolete.

Efficiency of such installations compared with that of systems operating on combustible materials is very low.

Bearing in mind the considerable cost of high resistance materials as well, all this makes for high purchasing and running costs.

It is well known in all cases a great deal of the output of a system is lost along the thermal chain from generators to appliances, especially due to the great difference between the temperature of the flame or of the electric heating elements and the temperature to be provided, with the result that actual the amount of energy used is very low when compared with that available and consumed in the process.

The document WO-A-9 522 236 discloses a system for transforming electric energy into thermal energy already diffused by conductor bodies of high conductivity having a thickness measurable in microns, compatible with their formation and with the resistance to stresses during use that may be made from films obtained by electroplating or similar processes.

The purpose of these characteristics is to eliminate the following drawbacks; The high temperatures of the conductors require special means of support of special materials such as ceramic and the like, difficult to construct, fragile, and complex insulating and coating structures "The high temperatures cause these structures to become rapidly obsolete . . . " and clearly define the field and modes of application of the patent since its purpose is also undoubtedly that of limiting the temperature in the heat generators to substantially low values.

Conductors of micrometric thickness may also be obtained by electroplating cannot in fact withstand high temperatures nor can the supports for conductors for low temperatures used to replace those of ceramic and the like specifically required for high temperatures."

Subject invention permits transformation of electric energy into thermal energy already diffused achieving a level of efficiency much greater than that offered by present techniques, this also in the field of the high temperatures that cannot be reached on the basis of the document described, as will be explained here below.

SUMMARY OF THE INVENTION

Subject of the invention is a system for transforming electric energy into thermal energy already diffused, at high temperature.

The electric circuit is closed by electric resistances formed of conductors possessing very high electric conduction, such as copper and aluminium, having a very thin constant cross section and a high ratio between width and thickness, applied flat with fixed fastenings, side by side reciprocally insulated, on a support that offers a superior degree of insulation against high temperatures.

A continuous heat-emitting surface is thus obtained and therefore, in relation to the prior art, a drastic increase in surface extension of the resistances with generation of thermal energy already diffused and a far lower thermal and dimensional difference in relation to the bodies and volumes to be heated.

The support is formed of a strongly insulating sheet backed with a thick layer of insulating material covered, on its other face, with a protective sheet of metal or of some other material.

The strongly insulating sheet is preferably of mica.

The fastening means are preferably clips formed of a long thin metal body bent in the shape of a wide "U" with an intermediate linear section and shanks bent at 90°, forced into the insulating support through pairs of holes made in said conductors, of a diameter considerably greater than the width of each shank of the "U" in order to ensure sufficient space between each shank and the hole in the conductor.

In another type of execution the clips can be driven into the conductors and into the insulating support even without holes being made in said conductors.

In one type of execution fastening is done by mechanical stapling. Said stapling can hold the conductors and the heavily insulated sheet together or can even fix the conductors to the whole insulating support. The band-shaped conductors are advantageously laid serpentine-wise. A serpentine can also be obtained by making parallel cuts in a sheet, starting first from one edge and then from the opposite edge.

In other types of execution the band-shaped conductors are placed in a spiral that may be circular, square, rectangular or of some other shape. Optimum thickness of the conductors is between 0.1 and 0.5 mm. Along their length the conductors may have a constant or different cross section according to the amount of heat and the temperature level to be reached in the various sections of the length.

Dimensional variations may be gradual or sudden, continuous or discontinuous according to circumstances or needs.

Electric feed may reach the conductors either at their ends or in intermediate areas.

Values of current that feed the ends or intermediate areas may be equal or different.

Optimum temperatures of the generators described vary from 300 to 800° C.:

Said generators may advantageously take the form of panels.

In one type of execution said panels are completed by a four-piece frame in the form of a U-shaped channel into which the main parts such as the mica sheet, the insulating plate and rear protective sheet are fixed.

The heat-emitting surfaces of the generators can be placed in the indoor spaces, where greater warmth than ordinary room temperature is required, for the purpose of securing physical or chemical changes in the materials, so creating static, tunnel or ring-shaped furnaces and the like through which materials to be baked or treated generally, such as impregnating means, may pass.

The advantages of the disclosure are evident.

The thermal energy produced by the low voltage electric energy is of a high temperature and simultaneously diffused, and is transmitted by electromagnetic waves of medium length and therefore by radiation.

In spite of the high temperature the system of fastenings, especially using the U-shaped clips fixed into the insulating support through pairs of holes made in the flat conductors, hole diameter being considerably greater than the section of the shanks forming the "U", ensures stability while allowing ample space for dilation of the conductors.

Concentrations of heat and high temperatures that would burn the area round the fastenings, inevitable with other systems, are here avoided. The above advantages are allied to a level of thermal efficiency far higher than that possible with prior art methods since the loss of heat, inevitable especially if conveyed by conduction or convection, is avoided while the cost of construction is much lower than with present generators there being no need for costly supporting bodies requiring strong thermal and electrical insulation.

The compact form of flat panels makes possible a variety of applications not only for heating static or moving bodies, as in present furnaces, but also for environmental heating.

Characteristics and purposes of the invention will be made still clearer by the following examples of its execution illustrated by diagrammatically drawn figure.

DESCRIPTION OF THE PREFERRED EMBODIMENTS

Figure 1:
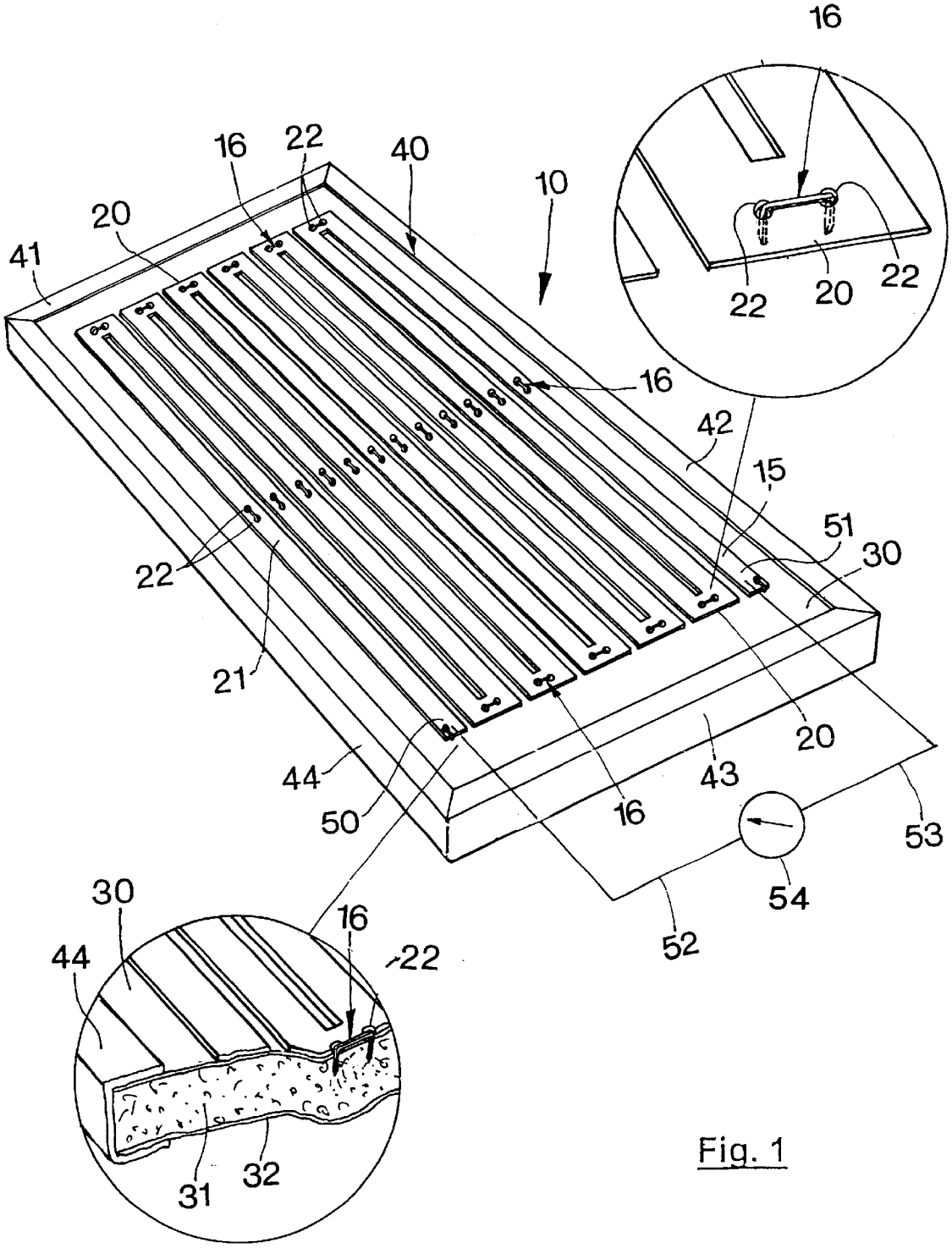
FIG. 1 Radiating panel with a band of aluminum laid serpentine-wise fixed with clips, perspective view with details.

The panel 10 comprises a heat 30 of mica on which a band 15, of aluminium 0.5 mm thick, is laid in the form of a serpentine, supported by a slab 31 of insulating foam material able to withstand high temperatures.

The slab is backed with a thin metal sheet 32.

The band 15 is fixed to the support, formed by the sheet 30 of mica and of the insulating slab 31, by means of clips 16 shaped like a wide "U" with a straight section 17 and shanks 18 bent at 90°, said clips being pressed into the material of the sheet 30 and slab 31.

The ends of said shanks 18 consist of sharp point 19.

At the heads 20 of said serpentine-laid bands 15 and about halfway along their length 21, are pairs of circular holes 22 of a diameter substantially greater, at a ratio of about 3 to 1, than that of the shanks 18 of the clips 16. The main parts shown, such as the mica sheet 30, the insulating slab 31 and the backing sheet 32 are assembled by the frame 30 consisting of four channel-shaped pieces 41, 44. The terminals 50 and 51 of the bands are joined by wires 52 and 53 to a source 54 of electric feed.

Figure 2:
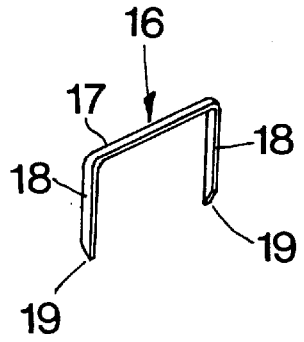
FIG. 2 Detail of the clip, perspective from above.
Figure 3:
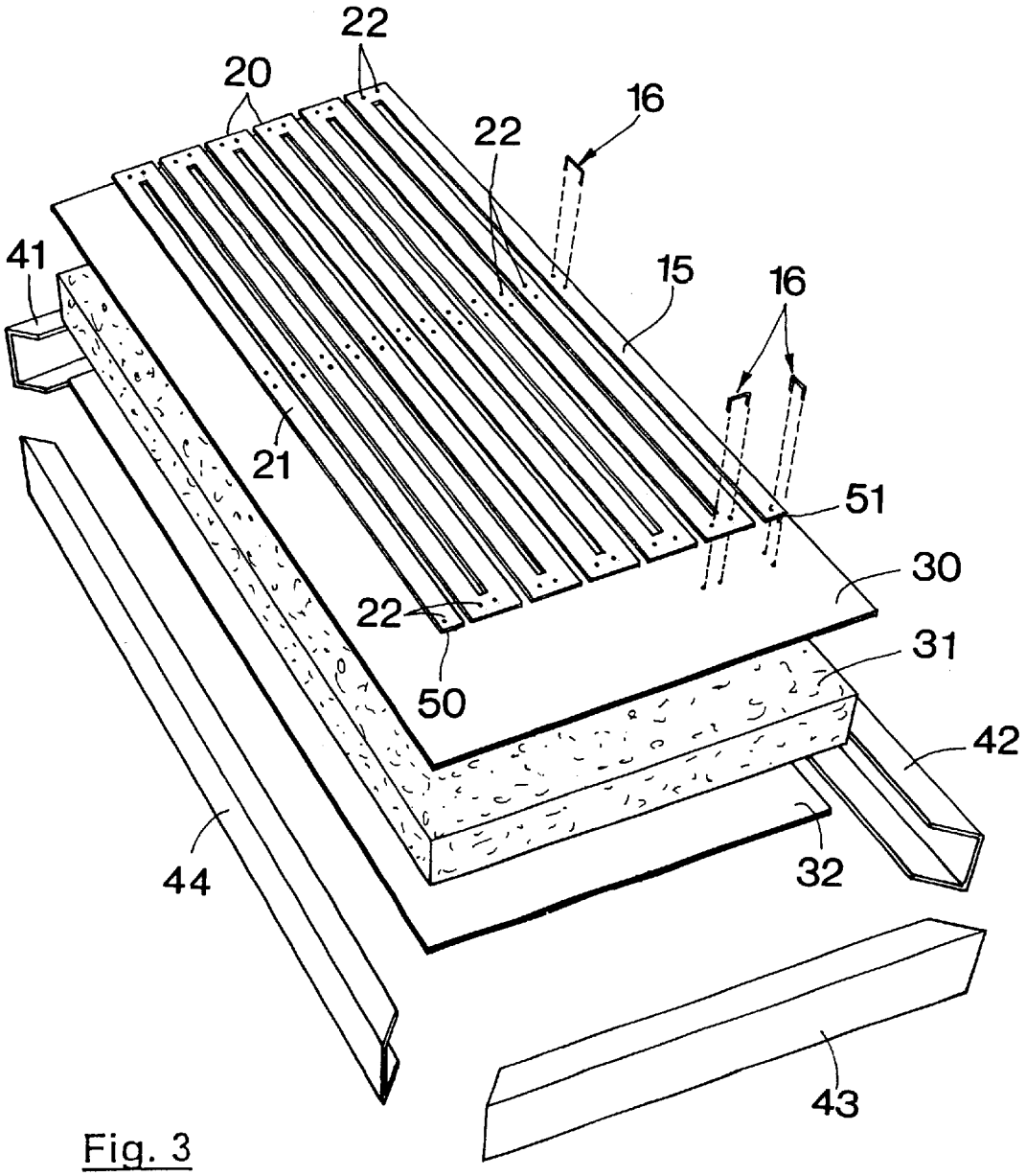
FIG. 3 Exploded view of the panel.
Figure 4:
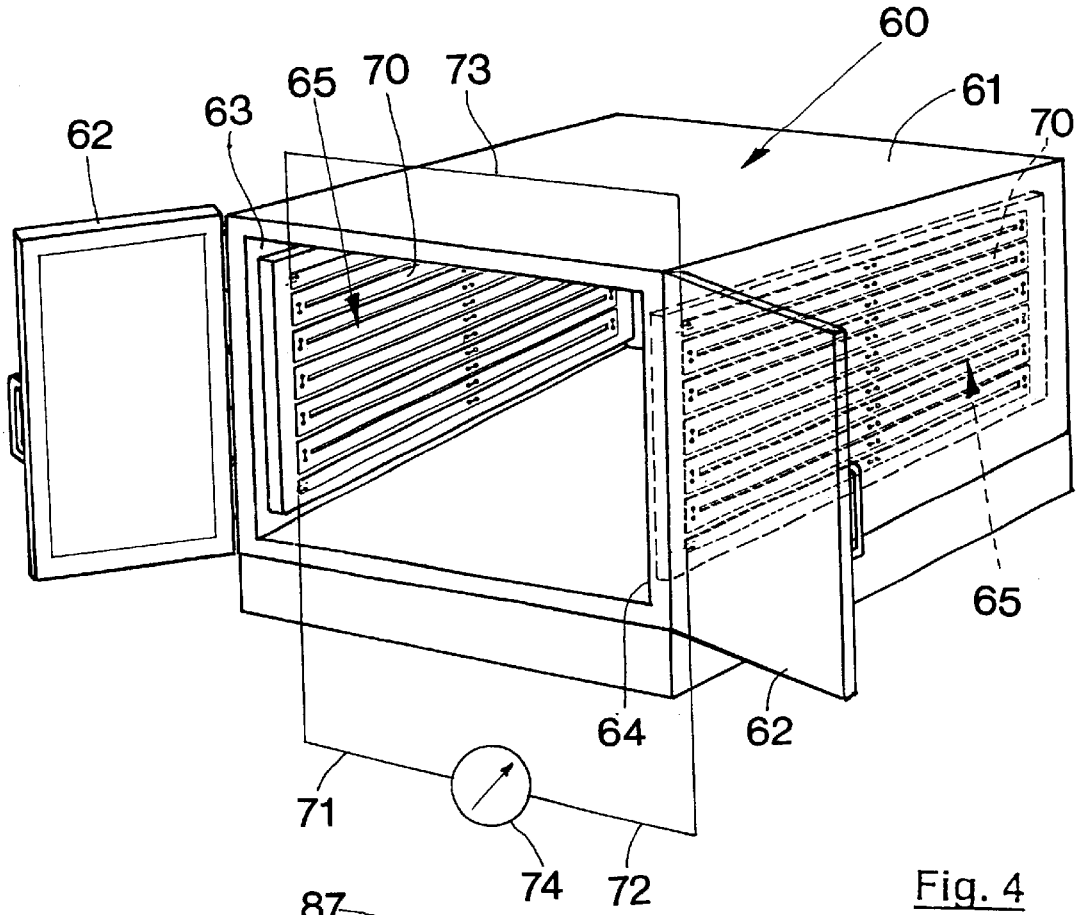
FIG. 4 Static furnace made with the radiant panels, perspective.

FIG. 4 shows a furnace 60 of a substantially parallelepiped structure 61, with doors 62 whose inner sides 63, 64 are lined with a pair of panels 65 substantially the same as those shown in FIGS. 1–3.

The terminals of the aluminum bands 70 are joined by wires 71, 72 and 73 to a source 74 of electric energy.

Figure 5:
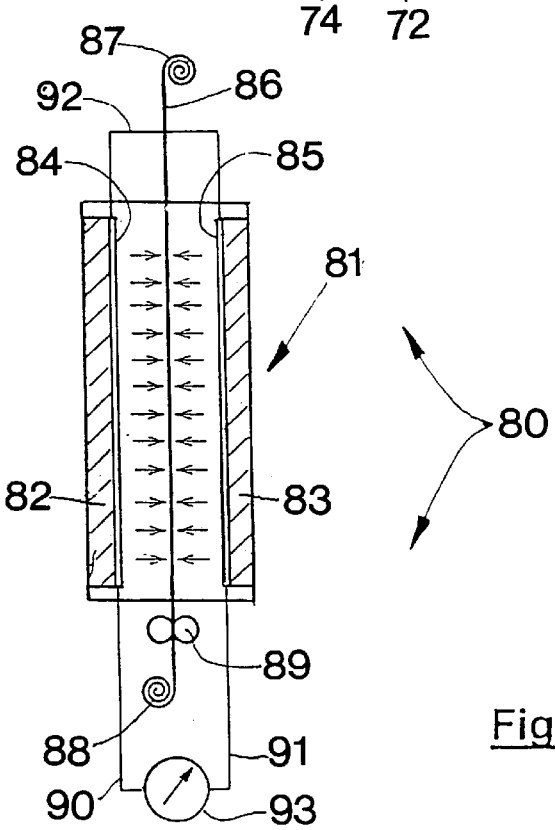
FIG. 5 Tunnel furnace, made with the radiant panels, for an impregnator, perspective.

FIG. 5 shows an impregnating means 80 and the tunnel furnace 81. Panels 84 and 85 similar to those described are mounted on the refractary sides 82 and 83 and radiate heat directly on the two faces of the band 86 sliding slowly between the reels 87 and 88 drawn along by the pair 89 of rollers.

The conductors of said panels 84, 85 are connected by wires 90–92 to the source 93 of electric energy.

What is claim is:

1. A system for transforming electrical energy into thermal energy, already diffused, comprising a flat support; and a substantially continuous heat-emitting surface formed by one or more electrically conducting continuous strips, each having a constant thickness, laid flat in parallel lengths and spaced for electrical insulation, said strips being arranged on said flat support and mechanically connected to it.

2. A system as defined in claim 1, wherein said strips are composed of copper.

3. A system as defined in claim 1, wherein said strips are composed of aluminum.

4. A system as defined in claim 1, wherein said support includes a thin electrically-insulating sheet, a slab composed of heat-insulating material and located behind said sheet, and a thin metal sheet located at a rear of said slab.

5. A system as defined in claim 4, wherein said thin electrically-insulating sheet is composed of mica.

6. A system as defined in claim 4, wherein said means for mechanically connecting said strips to said flat support include metal clips having a shape of a wide U including a central straight portion and shanks at 90° having pointed tips which are fixed into said support through pairs of holes provided in said strips, said holes having a diameter which is considerably greater than a width of each of said shanks to allow for dilation of said strips when heated to working temperature.

7. A system as defined in claim 4, wherein said means for mechanically connecting said strips to said flat support are stapling means.

8. A system as defined in claim 4, wherein said strips are placed on said support in form of a serpentine.

9. A system as defined in claim 4, wherein said strips are placed on said support in a square spiral.

10. A system as defined in claim 4, wherein said strips are placed on said support in a circular spiral.

11. A system as defined in claim 4, wherein said strips are strips which are formed by making parallel cuts in a sheet that start alternatively for two opposite edges of the sheet and extend to within a short distance from an edge opposite to a starting edge.

12. A system as defined in claim 4, wherein each of said strip has a length, a width, and a thickness such that values of electric current calculated by dimensions of said strips and consequent thermal effects are more suitable for use with corresponding appliances.

13. A system as defined in claim 4, wherein said strips have a thickness between 0.1 and 0.5 mm.

14. A system as defined in claim 4, wherein said strips are formed so that a strip temperature under load varies between 300° and 800° C.

15. A heat generator comprising a plurality of units each including a flat support; and a substantially continuous heat-emitting surface formed by one or more electrically conducting continuous strips, each having a constant thickness, laid flat in parallel lengths and spaced for electrical insulation, said strips being arranged on said flat support and mechanically connected to it.

16. A heat generator as defined in claim 15, wherein said units are formed as panels.

17. A heat generator as defined in claim 15; and further comprising a frame composed of four pieces and forming a U-shaped channel, said panels being arranged in said channel.

18. A heat generator as defined in claim 15, wherein said heat-emitting surfaces of said strips enclose volumes in which a temperature produces physical or chemical changes in materials.

19. A heat generator as defined in claim 15, wherein said heat-emitting surfaces of said strips form spaces in which a temperature produces physical or chemical changes in moving materials, creating panel ovens or ring-shaped ovens.

20. A heat generator as defined in claim 19, wherein said ovens are impregnating ovens.

* * * * *